US011243553B1

(12) United States Patent
Ilie et al.

(10) Patent No.: US 11,243,553 B1
(45) Date of Patent: Feb. 8, 2022

(54) LOW-DROPOUT REGULATION OF OUTPUT VOLTAGE USING FIRST BUFFER AND SECOND BUFFER

(71) Applicant: Infineon Technologies AG, Neubiberg (DE)

(72) Inventors: Ionut-Alin Ilie, Bucharest (RO); Cristian Garbossa, Bressanone (IT); Cristian Stefan Zegheru, Bucharest (RO)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 17/009,336

(22) Filed: Sep. 1, 2020

(51) Int. Cl.

| | |
|---|---|
| ***G05F 1/575*** | (2006.01) |
| ***G05F 1/46*** | (2006.01) |
| ***G05F 1/565*** | (2006.01) |
| ***G05F 1/445*** | (2006.01) |

(52) U.S. Cl.
CPC ..... *G05F 1/575* (2013.01); *G05F 1/445* (2013.01); *G05F 1/461* (2013.01); *G05F 1/565* (2013.01)

(58) Field of Classification Search
CPC ..... G05F 1/575; G05F 1/445; G05F 1/461; G05F 1/565
See application file for complete search history.

(56) References Cited

U.S. PATENT DOCUMENTS

| | | | | |
|---|---|---|---|---|
| 9,933,801 | B1 * | 4/2018 | Guan | G05F 1/575 |
| 10,281,943 | B1 * | 5/2019 | Ho | G05F 1/575 |
| 2009/0009147 | A1 * | 1/2009 | Jian | G05F 1/575 323/280 |
| 2019/0146531 | A1 * | 5/2019 | Yung | G05F 1/563 363/21.01 |
| 2021/0026384 | A1 * | 1/2021 | Jin | G05F 1/575 |

* cited by examiner

*Primary Examiner* — Kyle J Moody
*Assistant Examiner* — Lakaisha Jackson
(74) *Attorney, Agent, or Firm* — Shumaker & Sieffert, P.A.

(57) ABSTRACT

A circuit configured to perform low-dropout regulation of an output voltage includes a first buffer, a second buffer, controller circuitry, and switching circuitry. The first buffer includes a first driving element configured to provide a first current into a first output node based on the output voltage. The first bias circuitry is configured to bias the first current. The second buffer includes a second driving element configured to provide a second current into a second output node based on a voltage at the first output node. The second bias circuitry is configured to bias the second current. The controller circuitry is configured to generate a control signal based on a current at the pass device and switching circuitry configured to electrically couple the first output node to the control node of the pass device based on the control signal.

20 Claims, 5 Drawing Sheets

LOW-DROPOUT REGULATION OF OUTPUT VOLTAGE USING FIRST BUFFER AND SECOND BUFFER

TECHNICAL FIELD

This disclosure relates to linear voltage regulators, such as low-dropout (LDO) regulators that are configured to regulate an output voltage.

BACKGROUND

Linear voltage regulators may regulate an output voltage. For example, a linear voltage regulator may output a voltage of 5 volts using a supplied voltage of 10 volts. A low-dropout (LDO) regulator may regulate an output voltage that is close to a supplied voltage. For instance, an LDO regulator may output a voltage of 5 volts using a supplied voltage of 5.5 volts. In any case, it may be desirable for linear voltage regulators, such as LDO regulators, to quickly achieve a regulated voltage, be stable across a full range of output voltages, and have a low power consumption.

SUMMARY

The disclosure describes techniques, devices, and systems for low-dropout regulation of an output voltage. Rather than relying only on a p-type metal-oxide-semiconductor (PMOS) buffer, which may have relatively good undershoot performance and poor overshoot performance, or only on an n-type metal-oxide-semiconductor (NMOS) buffer, which may have relatively good overshoot performance and poor undershoot performance, a circuit may be configured to include a first buffer, a second buffer, and switching circuitry configured to bypass the second buffer. In this way, the circuit may use different types of buffers and improve the driving of a pass device.

In one example, the disclosure is directed to a circuit configured to perform low-dropout regulation of an output voltage. The circuit includes a first buffer, a second buffer, controller circuitry, and switching circuitry. The first buffer includes a first driving element configured to provide a first current into a first output node based on the output voltage and first bias circuitry configured to bias the first current. The second buffer includes a second driving element configured to provide a second current into a second output node based on a voltage at the first output node and second bias circuitry configured to bias the second current. The second output node is configured to be electrically coupled to a control node of a pass device. The pass device further includes a first node electrically coupled to a supply and a second node configured to generate the output voltage. The controller circuitry is configured to generate a control signal based on a current at the pass device. The switching circuitry is configured to electrically couple the first output node to the control node of the pass device based on the control signal.

In another example, the disclosure is directed to a method for low-dropout regulation of an output voltage. The method includes providing, based on the output voltage, a first current into a first output node of a first driving element of a first buffer and biasing, by first bias circuitry, the first current. The method further includes providing, based on a voltage at the first output node, a second current into a second output node of a second driving element of a second buffer and biasing, by second bias circuitry, the second current. The second output node is configured to be electrically coupled to a control node of a pass device. The pass device further comprises a first node electrically coupled to a supply and a second node configured to generate the output voltage. The method further includes generating a control signal based on a current at the pass device and electrically coupling the first output node of the first driving element to the control node of the pass device based on the control signal.

In one example, the disclosure is directed to a system including a pass device and a circuit. The pass device comprises a control node, a first node electrically coupled to a supply, and a second node configured to generate an output voltage. The circuit is configured to perform low-dropout regulation of the output voltage of the pass device. The circuit includes a first buffer, a second buffer, controller circuitry, and switching circuitry. The first buffer includes a first driving element configured to provide a first current into a first output node based on the output voltage and first bias circuitry configured to bias the first current. The second buffer comprises a second driving element configured to provide a second current into a second output node based on a voltage at the first output node and second bias circuitry configured to bias the second current flow. The second output node is configured to be electrically coupled to the control node of the pass device. The controller circuitry is configured to generate a control signal based on a current at the pass device. The switching circuitry is configured to electrically couple the first output node to the control node of the pass device based on the control signal.

In another example, the disclosure is directed to an apparatus comprising: means for providing, based on the output voltage, a first current into a first output node of a first driving element of a first buffer and biasing, by first bias circuitry, the first current. The apparatus further includes means for providing, based on a voltage at the first output node, a second current into a second output node of a second driving element of a second buffer and means for biasing the second current. The second output node is configured to be electrically coupled to a control node of a pass device. The pass device further comprises a first node electrically coupled to a supply and a second node configured to generate the output voltage. The apparatus further includes means for generating a control signal based on a current at the pass device and means for electrically coupling the first output node of the first driving element to the control node of the pass device based on the control signal.

The details of one or more examples are set forth in the accompanying drawings and the description below. Other features, objects, and advantages of the disclosure will be apparent from the description and drawings, and from the claims.

Figure 1:
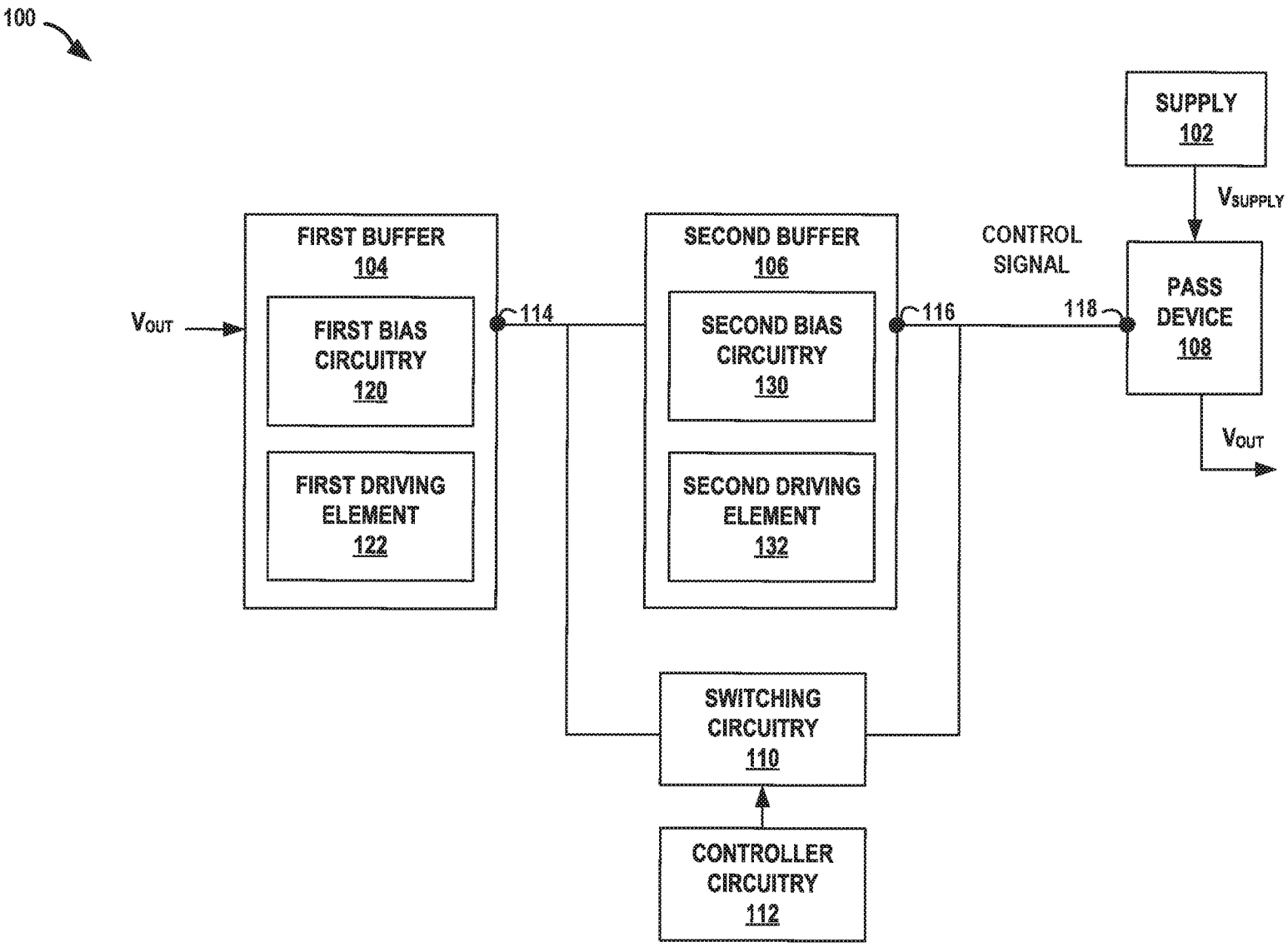
FIG. 1 is a block diagram illustrating an example system configured to perform low-dropout regulation of an output voltage, in accordance with one or more techniques of this disclosure.

The details of one or more examples are set forth in the accompanying drawings and the description below. Other features, objects, and advantages will be apparent from the description, drawings, and claims.

DETAILED DESCRIPTION

The disclosure describes techniques, devices, and systems for low-dropout (LDO) regulation of an output voltage. Low-dropout regulators imposed by current market trends may be configured for withstanding transients at their output and input coming from different sources. The ability of the low-dropout regulator to withstand transients is reflected in key parameters, such as, for example, a transient load regulation and a transient line regulation. High output voltage precision, even in response to transients (e.g., in terms of undershoot/overshoot), is desirable in many applications. Techniques described herein may potentially reduce or eliminate undershoot and overshoot, even in response to high disturbances on an input and/or output.

Some linear regulators may use a p-type metal-oxide-semiconductor (PMOS) transistor or a PNP transistor (referred to herein as simply a "PMOS/PNP buffer") as a driver for a pass device. Using a PMOS/PNP buffer technique has the advantage of a very good undershoot performance, but has the disadvantage of a poor overshoot performance (e.g., limited by the bias current of the PMOS/PNP buffer). Another disadvantage of the PMOS/PNP buffer technique is that the on-resistance ($R_{ON}$) of the pass device is not selected to allow a gate/base of the pass device to reach a negative rail of the supply because of a source-to-gate voltage ($V_{SG}$) of a PMOS buffer or an emitter-base voltage ($V_{EB}$) of a PNP buffer.

Some linear regulators may use an n-type metal-oxide-semiconductor (NMOS) transistor or an NPN transistor (referred to herein as simply a "NMOS/NPN buffer") as a driver for a pass device. Using a NMOS/NPN buffer technique has the advantage of a very good overshoot performance, but has the disadvantage of a poor undershoot performance (e.g., limited by the bias current of this stage). Another disadvantage of the NMOS/NPN buffer technique is that the output voltage will increase uncontrollably at very low output currents because of a deep subthreshold conduction of the pass device (e.g., $V_{SG}/V_{EB}$ of the pass device cannot be smaller than a gate-to-source voltage ($V_{GS}$ or a base-to-emitter voltage ($V_{BE}$) of the NMOS/NPN buffer, which may result in the linear regulator being in open loop control.

Some linear regulators may use a push pull buffer as a driver for the pass device. The push pull buffer technique has the advantage of very good undershoot and overshoot performance, but has at least two disadvantages. One disadvantage of the push pull buffer is that the on-resistance (RON) of the pass device is not selected to allow a gate/base of the pass device to reach a negative rail, which may directly affect the efficiency of the regulator. Another disadvantage of the push pull buffer is that the output voltage may increase uncontrollable at very low output currents because of the deep subthreshold conduction of the pass device, which may restrict the output current.

In accordance with the techniques of the disclosure, a circuit may be configured to include two different types of buffers. The circuit may include a first buffer, for example a PMOS/PNP buffer, and a second buffer, for example a NMOS/NPN buffer. The circuit may be configured to connect the first buffer and second buffer in different situations in order to improve the driving of a pass device in an LDO regulator. For example, a circuit may be configured to include a first buffer and a second buffer, and the first buffer and the second buffer may be cascaded connected. The circuit may include switching circuitry to bypass the second buffer. For instance, the first buffer may be a PMOS/PNP buffer and the second buffer may be a NMOS/NPN buffer. At low output currents, the switching circuitry is ON (e.g., switched-in), the bias current for the NMOS buffer is OFF, thereby bypassing the NMOS buffer. That is, the circuit drives the pass device as a PMOS/PNP buffer when the switching circuitry is ON. At high output currents, the switching circuitry is OFF (e.g., switched-out) and the bias current for NMOS buffer is ON. When the switching circuitry is OFF, the circuit drives the pass device with two cascaded buffers, the PMOS buffer followed by the NMOS buffer. Controller circuitry may control the switching circuitry based on the output current. The controller circuitry may control a bias current source of NMOS buffer.

The circuit configured to include a first buffer and a second buffer as described herein may provide the good undershoot performance granted by the PMOS/PNP buffer when a jump from low to high output current appears. In some examples, the circuit configured to include a first buffer and a second buffer as described herein may provide the good overshoot performance granted by the NMOS/NPN buffer when a jump from high to low output current appears. Moreover, the circuit configured to include a first buffer and a second buffer as described herein may be configured with a value for $R_{ON}$ granted by the use the NMOS/NPN buffer that is improved over systems using the push pull buffer. Additionally, the circuit configured to include a first buffer and a second buffer as described herein may regulate the output voltage at the pass device even at very low output currents (e.g., where the pass device is operating in a subthreshold conduction state), granted by the usage of the PMOS/PNP buffer, which can drive the gate or base of the pass device very close to the input voltage of the pass device.

FIG. 1 is a block diagram illustrating an example system configured to perform low-dropout regulation of an output voltage, in accordance with one or more techniques of this disclosure. As illustrated in the example of FIG. 1, system 100 may include a supply 102, a first buffer 104, a second buffer 106, a pass device 108, switching circuitry 110, and controller circuitry 112.

Supply 102 may be configured to provide electrical power to one or more other components of system 100. For instance, supply 102 may be configured to supply an input voltage ($V_{supply}$) to pass device 108. In some examples, supply 102 includes a battery which may be configured to store electrical energy. Examples of batteries may include, but are not limited to, nickel-cadmium, lead-acid, nickel-metal hydride, nickel-zinc, silver-oxide, lithium-ion, lithium polymer, any other type of rechargeable battery, or any combination of the same. In some examples, supply 102 may include an output of a power converter or power inverter. For instance, supply 102 may include an output of a direct current (DC) to DC power converter, an alternating current (AC) to DC power converter, and the like. In some examples, supply 102 may represent a connection to an electrical supply grid. In some examples, supply 102 may be configured to provide a DC input power signal in the range of ~5 VDC to ~40 VDC. In some examples, supply 102 may include a plurality of regulators, for example, connected in cascade.

First buffer 104 may include first bias circuitry 120 and a first driving element 122. First driving element 122 may be configured to provide a first current into a first output node 114 based on the output voltage at pass device 108. First driving element 122 may be a p-type metal-oxide-semiconductor (PMOS) transistor or a PNP transistor. In some examples, first driving element 122 may be configured to operate in an active region between cut-off and saturation. First bias circuitry 120 may be configured to bias the first current. First bias circuitry 120 may include a first current source. In some examples, first bias circuitry 120 may include a first resistor.

Second buffer 106 may include second bias circuitry 130 and a second driving element 132. Second driving element 132 may be configured to provide a second current into a second output node 116 based on a voltage at the first output node 114. Second driving element 132 may be a n-type metal-oxide-semiconductor (NMOS) transistor or a NPN transistor. In some examples, second driving element 132 may be configured to operate in an active region between cut-off and saturation. Second bias circuitry 130 may be configured to bias the second current. Second bias circuitry 130 may include a second current source. In some examples, second bias circuitry 130 may include a second resistor.

Generally, driving elements (e.g., first driving element 122 and second driving element 132) may include a silicon controlled rectifier (SCR), a field effect transistor (FET), a bipolar junction transistor (BJT), or another driving element. Examples of FETs may include, but are not limited to, junction field-effect transistor (JFET), metal-oxide-semiconductor FET (MOSFET), dual-gate MOSFET, insulated-gate bipolar transistor (IGBT), any other type of FET, or any combination of the same. Examples of MOSFETS may include, but are not limited to, depletion mode p-channel MOSFET (PMOS), enhancement mode PMOS, depletion mode n-channel MOSFET (NMOS), enhancement mode NMOS, double-diffused MOSFET (DMOS), or any other type of MOSFET, or any combination of the same. Examples of BJTs may include, but are not limited to, PNP, NPN, heterojunction, or any other type of BJT.

As shown, second output node 116 may be configured to be electrically coupled to a control node 118 of pass device 108. Pass device 108 may include a first node electrically coupled to supply 102 and a second node configured to generate the output voltage ($V_{OUT}$). Pass device 108 may include a p-type metal-oxide-semiconductor (PMOS) transistor.

Controller circuitry 112 may be configured to generate a control signal based on a current at pass device 108. For example, controller circuitry 112 may generate the control signal to drive switching circuitry 110 to electrically couple first output node 114 to a control node 118 of pass device 108 when the current at pass device 108 is less than a threshold and drive switching circuitry 110 to refrain from electrically coupling first output node 114 to control node 118 of pass device 108 when the current at pass device 108 is not less than the threshold. In some examples, the threshold may be set at a value corresponding to a low output current where pass device 108 is operating in a subthreshold conduction state. In some examples, the threshold may be set at a value corresponding to a low output current where pass device 108 is operating in a saturation state.

Switching circuitry 110 may be configured to electrically couple first output node 114 to control node 118 of pass device 108 based on the control signal output by controller circuitry 112. Switching circuitry 110 may include a silicon controlled rectifier (SCR), a field effect transistor (FET), a bipolar junction transistor (BJT), or another driving element. In some examples, switching circuitry 110 may include a mechanical switch. Switching circuitry 110 may be configured to operate in an open state (e.g., a cut-off region) and a closed state (e.g., a saturation region). In some examples, switching circuitry 110 may be configured to refrain from operating in the active region.

Figure 2:
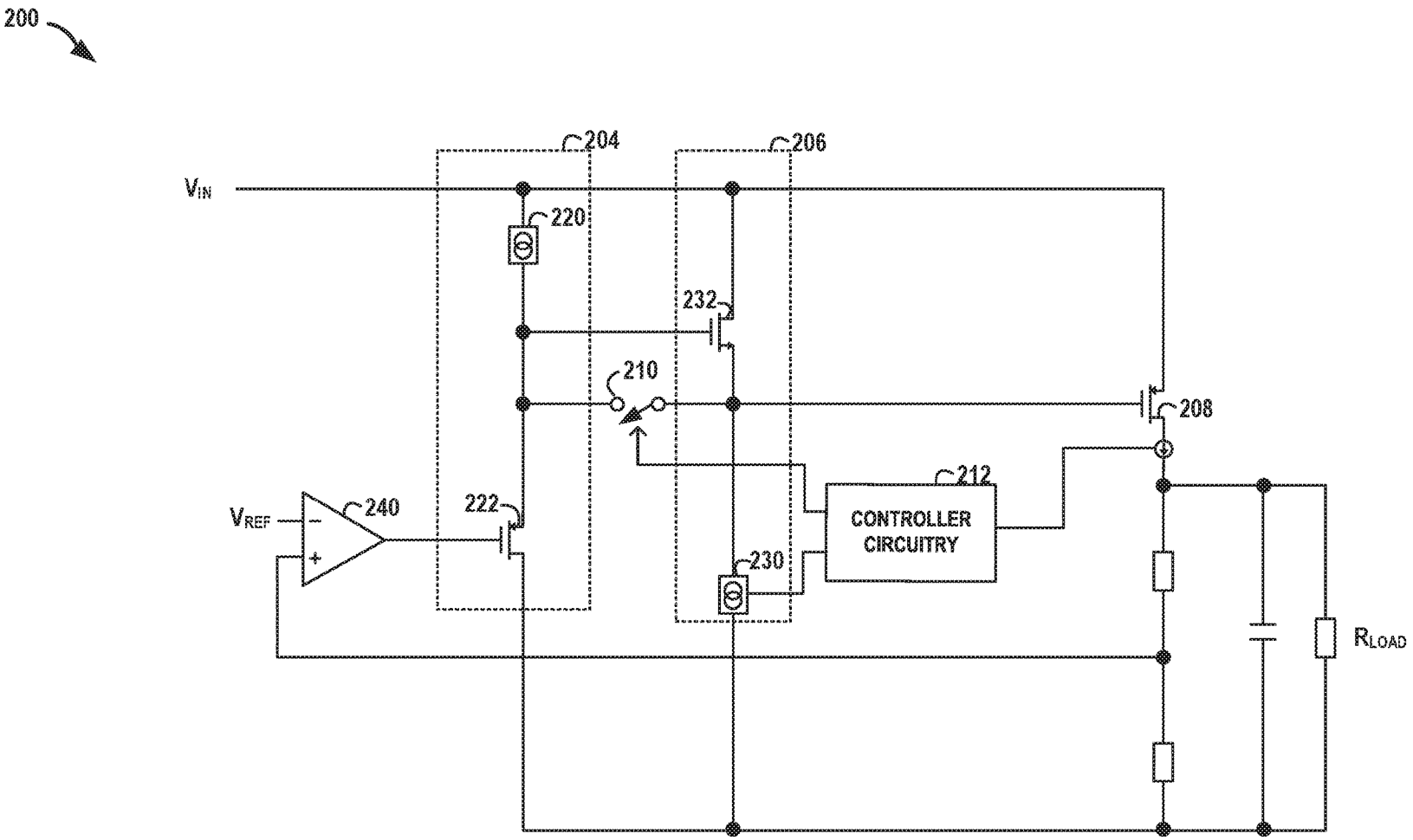
FIG. 2 is a block diagram illustrating an example first circuit configured to perform low-dropout regulation of an output voltage, in accordance with one or more techniques of this disclosure.

FIG. 2 is a block diagram illustrating an example first circuit 200 configured to perform low-dropout regulation of an output voltage, in accordance with one or more techniques of this disclosure. As illustrated in the example of FIG. 2, circuit 200 may include a first buffer 204, a second buffer 206, a pass device 208, switching circuitry 210, and controller circuitry 212, which are examples of first buffer 104, second buffer 106, pass device 108, switching circuitry 110, and controller circuitry 112 of FIG. 1. For example, first buffer 204 may include first bias circuitry 220 and first driving element 222 and second buffer 206 may include second bias circuitry 230 and second driving element 232. As shown, first bias circuitry 220 comprises a first current source and first driving element 222 comprises a PMOS transistor. Similarly, second bias circuitry 230 may include a second current source and second driving element 232 may include an NMOS transistor.

In the example of FIG. 2, circuit 200 further includes an error amplifier 240. Error amplifier 240 may be configured to provide a third current into an input node of a first driving element 222 when an indication of the output voltage is less than a reference voltage. For example, a positive terminal of error amplifier 240 may be electrically coupled to an output of a voltage divider that generates an indication of the output voltage and the negative terminal of error amplifier 240 may be electrically coupled to a reference voltage.

As shown in FIG. 2, first bias circuitry 220 may be configured to electrically couple a first terminal (e.g., a positive terminal) of the supply (e.g., supply 102 of FIG. 1) to a source of first driving element 222. A drain of first driving element 222 is configured to electrically couple to a second terminal (e.g., a negative terminal) of the supply. Similarly, second bias circuitry 230 may be configured to electrically couple the second terminal of the supply to a source of second driving element 232 and a drain of second driving element 232 may be configured to electrically couple to the first terminal of the supply.

Controller circuitry 212 may be configured to set second bias circuitry 230 to bias the second current flow to be less than a current threshold (e.g., zero) based on the current at pass device 308. For example, second bias circuitry 230 may be configured to set second bias circuitry 230 to bias the second current flow to correspond to zero when the current at pass device 208 is less than a threshold. The threshold may be set at a value corresponding to a low output current where pass device 208 is operating in a subthreshold conduction state. In some examples, the threshold may be set at a value corresponding to a low output current where pass device 208 is operating in a saturation state.

Controller circuitry 212 may include a shunt resistor coupled in series with pass device 208. In this example, to generate the control signal, controller circuitry 212 may be configured to generate the control signal based on a voltage at the shunt resistor. For example, controller circuitry 212 may be configured to generate the control signal to switch-out switching circuitry 210 when the voltage at the shunt resistor is less than a threshold and to switch-in switching circuitry 210 when the voltage at the shunt resistor is not less than the threshold.

Figure 3:
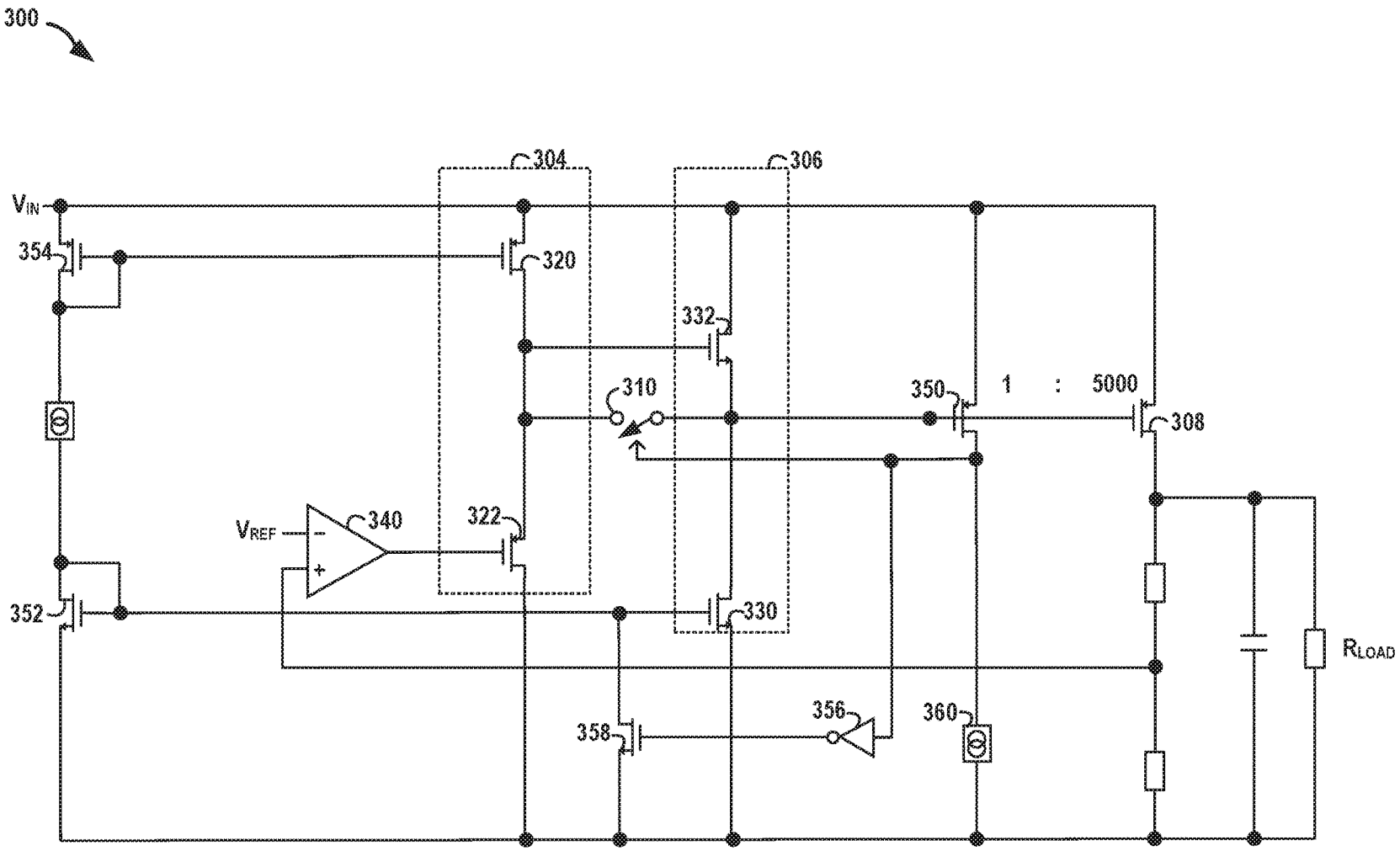
FIG. 3 is a block diagram illustrating an example second circuit configured to perform low-dropout regulation of an output voltage, in accordance with one or more techniques of this disclosure.

FIG. 3 is a block diagram illustrating an example second circuit configured to perform low-dropout regulation of an output voltage, in accordance with one or more techniques of this disclosure. As illustrated in the example of FIG. 3, circuit 300 may include a first buffer 304, a second buffer 306, a pass device 308, and switching circuitry 310, which are examples of first buffer 104, second buffer 106, pass device 108, and switching circuitry 110 of FIG. 1. For example, first buffer 304 may include first bias circuitry 320 and first driving element 322 and second buffer 306 may include second bias circuitry 330 and second driving element 332. As shown, first bias circuitry 320 comprises a first current source and first driving element 322 comprises a PMOS transistor. Similarly, second bias circuitry 330 may include a second current source and second driving element 332 may include an NMOS transistor.

The controller circuitry of FIG. 3 may be implemented with sensing element 350. Sensing element 350 may be configured to generate a sense current proportional to the current at pass device 308. In the example of FIG. 3, sensing element 350 may be configured to mirror a current at pass device 308 with a ratio of 1 to 5000, transistor 352, and transistor 354. In other examples, however, sensing element 350 and pass device 308 may have a different current ratio. As shown, third bias circuitry 360 may be configured to bias the sense current to generate the control signal for switching circuitry 310.

For example, circuit 300 may operate in a low output current mode and a high output current mode. When operating in the low output current mode, switching circuitry 310 is ON, which results in the $V_{GS}$ of second driving element 332 being 0 V and results in in the first driving element 322 being directly connected to the gate of pass device 308. When operating in the low output current mode, the bias current output by bias circuitry 330 results in second buffer 306 being switched off (e.g., using inverter 356 and transistor 358). That is, when operating in the low output current mode, the bias current output by bias circuitry 330 results in second buffer 306 providing no current to the gate of pass device 308. When operating in the low output current mode, circuit 300 includes a PMOS buffer implemented by first buffer 304 which grants a very good undershoot performance in the case of a high positive load step. At the same time, using the PMOS buffer implemented by first buffer 304 may result in the output voltage at pass device 308 being regulated even for very low output currents.

When operating in the high output current mode, switching circuitry 310 is OFF and the NMOS buffer implemented by second buffer 306 is enabled. In this case, circuit 300 includes two cascaded buffers: a PMOS buffer implemented by first buffer 304 followed by a NMOS buffer implemented by second buffer 306. Using the NMOS buffer implemented by second buffer 306 as a last stage in the loop helps to ensure a very good overshoot performance in case of a high negative load step, and also helps to ensure the value for $R_{ON}$ of pass device 308.

Figure 4:
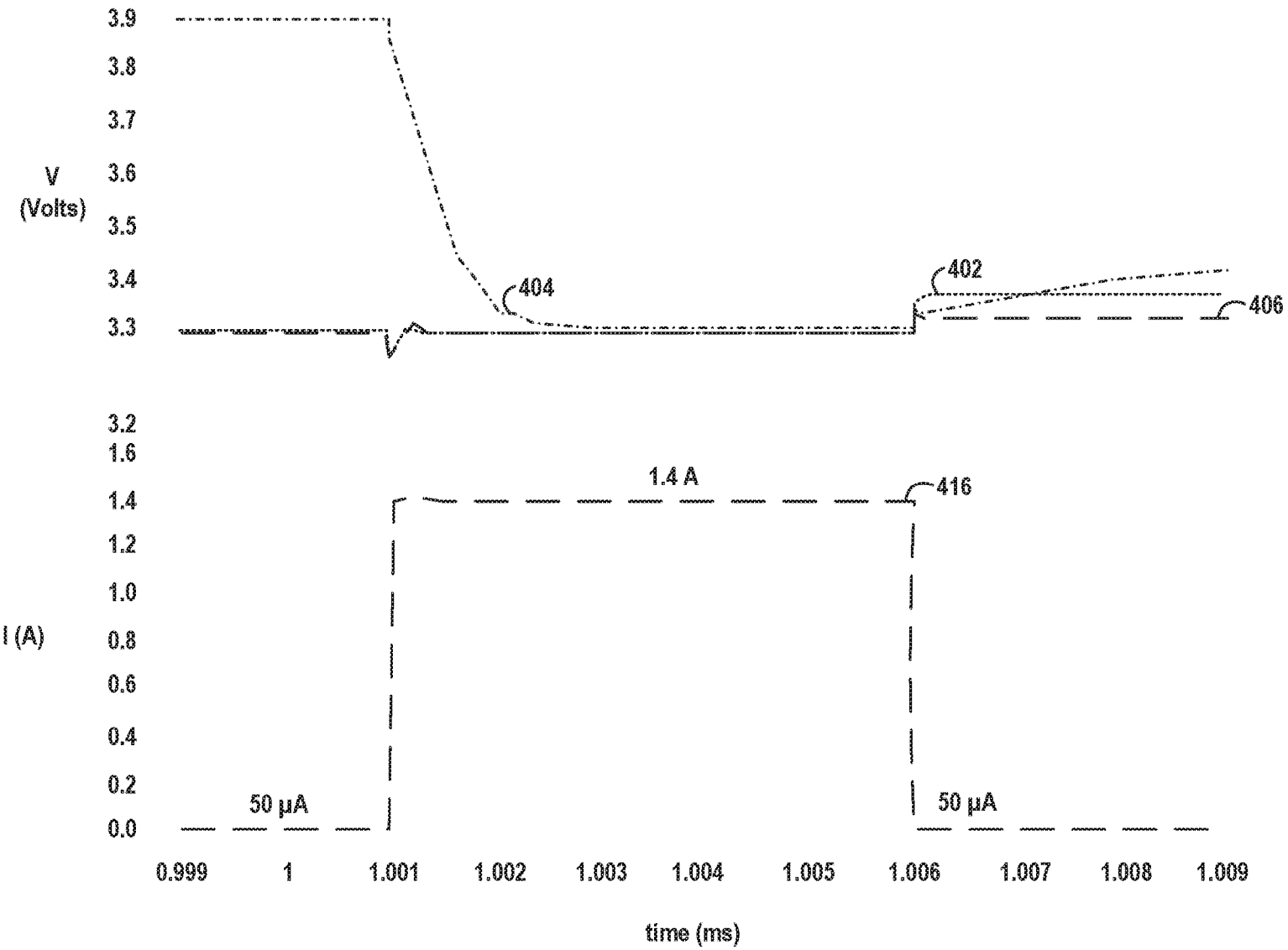
FIG. 4 is a graph illustrating and exemplary voltage and current response of a system configured to perform low-dropout regulation of an output voltage, in accordance with one or more techniques of this disclosure.

FIG. 4 is a graph illustrating an exemplary voltage and current response of a system configured to perform low-dropout regulation of an output voltage, in accordance with one or more techniques of this disclosure. FIG. 4 is discussed with reference to FIGS. 1-3 for example purposes only. The abscissa axis (e.g., the horizontal axis) of FIG. 4 represents time in milliseconds (ms) and the ordinate axis (e.g., the vertical axis) of FIG. 4 represents an output voltage 402 in volts (V) output by a PMOS/PNP buffer, an output voltage 404 in volts (V) output by an NMOS/NPN buffer, an output voltage 406 in volts (V) output by system 100 of FIG. 1, and current 416 through a load. During the simulation of FIG. 4, the input voltage was 3.9 Volts, the output voltage was 3.3 volts, the output capacitance was 2.2 micro-farads (CL=2.2 uF), and the operating temperature was 27° C.

As shown in FIG. 4, system 100 may provide very good undershoot performance granted by the PMOS/PNP buffer implemented by first buffer 104 when a jump from low to high output current appears and very good overshoot performance granted by the NMOS/NPN buffer implemented by second buffer 106 when a jump from high to low output current appears. System 100 may provide one or more of: (1) an desirable value for $R_{ON}$ granted by the use the NMOS/NPN buffer implemented by second buffer 106; or (2) a possibility of regulating the output voltage even at very low output currents (e.g., where pass device 108 is operating in a subthreshold conduction state), granted by the usage of the PMOS/PNP buffer implemented by first buffer 104 which can drive the gate/base of pass device 1018 very close to the input voltage.

Figure 5:
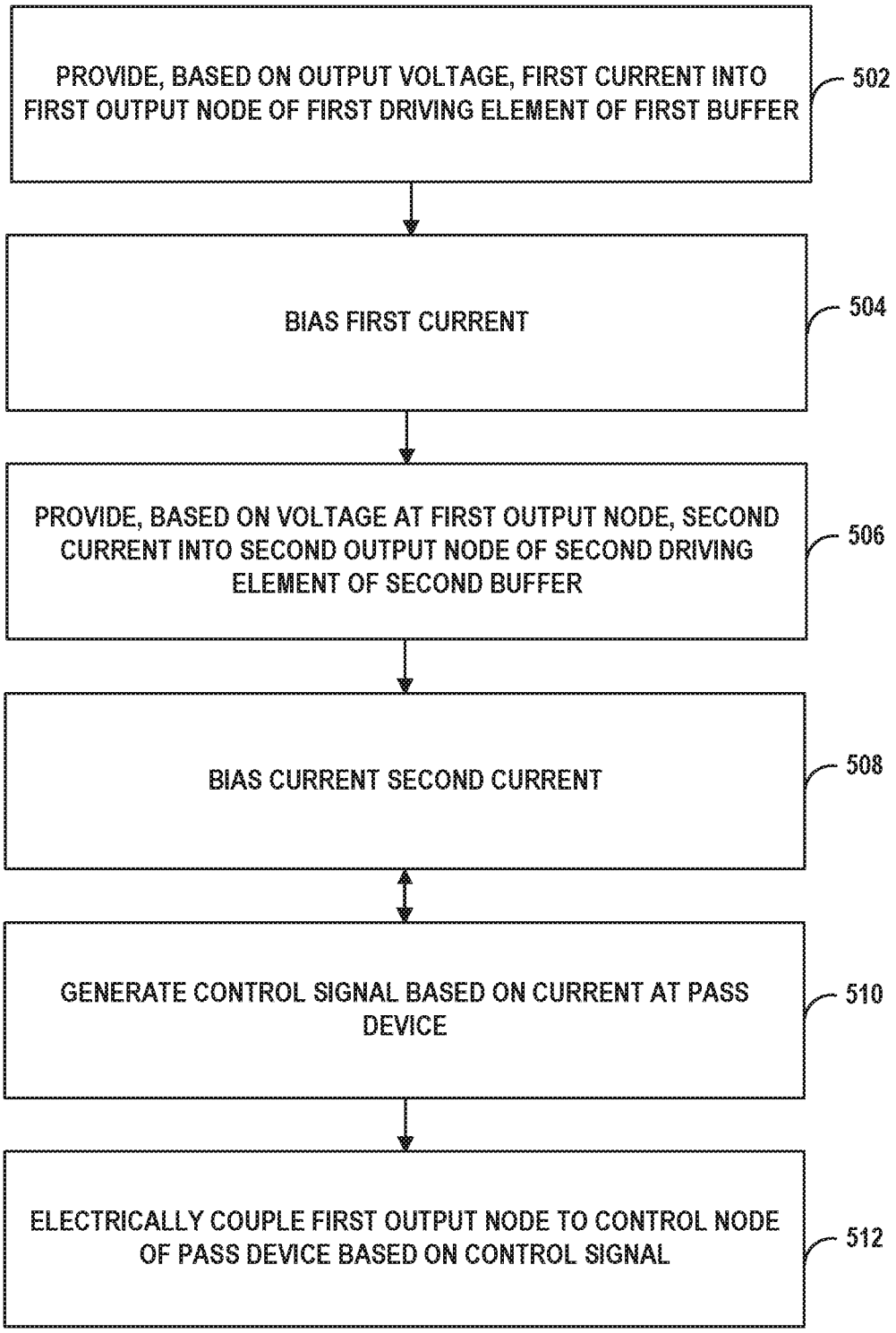
FIG. 5 is a flow diagram for a process of performing low-dropout regulation of an output voltage, in accordance with one or more techniques of this disclosure.

FIG. 5 is a flow diagram for a process of performing low-dropout regulation of an output voltage, in accordance with one or more techniques of this disclosure. FIG. 5 is discussed with reference to FIGS. 1-4 for example purposes only.

In accordance with the techniques of the disclosure, first driving element 122 may provide, based on the output voltage, a first current into first output node 114 of first driving element 122 of first buffer 104 (502). The first driving element 122 may comprise a PMOS transistor. In some examples, first driving element 122 may comprise a PNP transistor. Providing the first current into first output node 114 may cause system 100 to operate as a PMOS/PNP buffer when switching circuitry 110 is switched-in, which may regulate the output voltage at pass device 108 at very low output currents (e.g., where the pass device is operating in a subthreshold conduction state).

First bias circuitry 120 may bias the first current (504). First bias circuitry 120 may comprise a first current source. For instance, first bias circuitry 120 may comprise a MOSFET configured as a first current source (e.g., first bias circuitry 320 of FIG. 3). First bias circuitry 120 may be configured to electrically couple a first terminal (e.g., a positive terminal) of supply 102 to a source of first driving element 122. A drain of first driving element 122 may be configured to electrically couple to a second terminal (e.g., a negative terminal) of supply 102. In some examples, first bias circuitry 120 may comprise a first resistor. For instance, first bias circuitry 120 may comprise a first resistor arranged in series with a voltage source.

Second driving element 132 may provide, based on a voltage at first output node 114, a second current into second output node 116 of second driving element 132 of second buffer 106 (506). Second driving element 132 may comprise an NMOS transistor. In some examples, second driving element 132 may comprise an NPN transistor. Providing the second current into second output node 116 may cause system 100 to operate as a NMOS/NPN buffer, which may provide good overshoot when a jump from high to low output current appears and may provide a value for $R_{ON}$ that is improved over systems using the push pull buffer.

Second bias circuitry 130 may bias the second current (508). Second bias circuitry 130 may comprise a second current source. For instance, second bias circuitry 130 may comprise a MOSFET configured as a second current source (e.g., second bias circuitry 330 of FIG. 3). In some examples, second bias circuitry 130 may comprise a second resistor. For instance, second bias circuitry 130 may comprise a second resistor arranged in series with a voltage source. Second bias circuitry 130 may be configured to electrically couple the second terminal of supply 102 to a source of second driving element 132. A drain of second driving element 132 may be configured to electrically couple to the first terminal of supply 102.

Second output node 116 may be configured to be electrically coupled to control node 118 of pass device 108. Pass device 108 may further comprises a first node electrically coupled to supply 102 and a second node configured to generate the output voltage. In some examples, pass device 108 may comprise a PMOS transistor.

Controller circuitry 112 may generate a control signal based on a current at pass device 108 (510). For example, controller circuitry 112 may generate the control signal to electrically couple first output node 114 to control node 118 of pass device 108 when the current at pass device 108 is less than a threshold and refrain from electrically coupling first output node 114 to control node 118 of pass device 108 when the current at pass device 108 is not less than the threshold. In some examples, the threshold may be set at a value corresponding to a low output current where pass device 108 is operating in a subthreshold conduction state with a tolerance value added. Generating the control signal based on the current at pass device 108 may help to generate the control signal to drive switching circuitry 110 to cause system 100 to operate with closed-loop control when pass device 108 is operating in a subthreshold conduction state and when pass device 108 is not operating in a subthreshold conduction state.

Controller circuitry 112 may generate a sense current proportional to the current at pass device 108. For example, sensing element 350 of FIG. 3 may generate a sense current proportional (e.g., 5000 to 1 or another ratio) to the current at pass device 308. Controller circuitry 112 may bias the sense current to generate the control signal. For example, third bias circuitry 360 may bias the sense current to generate the control signal. In some examples, third bias circuitry 360 may bias the sense current at a value corresponding to a low output current where pass device 308 is operating in a subthreshold conduction state with a tolerance value added. In some examples, third bias circuitry 360 may bias the sense current at a value corresponding to a low output current where pass device 308 is operating in a saturation state.

In some examples, controller circuitry 112 may generate the control signal based on a voltage at a shunt resistor coupled in series with pass device 108. For example, rather than using sensing element 350 of FIG. 3, controller circuitry 112 may include a shunt resistor arranged between a first terminal (e.g., a positive node) of a supply and pass device 308.

In some examples, controller circuitry 112 may set second bias circuitry 130 to bias the second current to be less than a current threshold (e.g., zero) based on the current at pass device 108. Again, third bias circuitry 360 of FIG. 3 may set the threshold for controlling switching circuitry 310 at a value corresponding to a low output current where pass device 108 is operating in a subthreshold conduction state with a tolerance value added. In some examples, third bias circuitry 360 of FIG. 3 may set the threshold for controlling switching circuitry 310 at a value corresponding to a low output current where pass device 108 is operating in a saturation state.

In this example, inverter 356 and transistor 358, which may represent elements of controller circuitry, may drive second bias circuitry 330 to electrically couple the second output node (shown in FIG. 3 a gate of second driving element 332) to a second terminal of the source (e.g., a reference node, a negative terminal, ground, etc.) to bias the second current when the current at pass device 308 is not less than the threshold set by third bias circuitry 360. When electrically coupling the second output node to the second terminal, second bias circuitry 330 may be configured to operate in an active region between cut-off and saturation.

However, when the current at pass device 308 is less than the threshold set by third bias circuitry 360, inverter 356 and transistor 358, may refrain from driving second bias circuitry 330 to electrically couple the first output node to the second terminal. That is, inverter 356 and transistor 358 may drive second bias circuitry 330 such that second buffer 306 provides no current to the gate of pass element 308 when the current at pass device 308 is less than the threshold set by third bias circuitry 360. For example, inverter 356 and transistor 358 may drive second bias circuitry 330 to bias the second current to be less than a current threshold (e.g., zero plus a tolerance value added).

Switching circuitry 110 may electrically couple first output node 114 of first driving element 122 to control node 118 of pass device 108 based on the control signal (512). For example, switching circuitry 110 may be driven by controller circuitry 112 to activate or switch-in when the current at pass device 108 is less than a threshold. In this example, switching circuitry 110 may be driven by controller circuitry 112 to deactivate or switch-out when the current at pass device 108 is not less than the threshold. In some examples, switching circuitry 110 may be configured to operate only in a cut-off region where switching circuitry 110 is deactivated or switched-out and a saturation region where switching circuitry 110 is activated or switched-in.

The following examples may illustrate one or more aspects of the disclosure.

Example 1. A circuit configured to perform low-dropout regulation of an output voltage, the circuit comprising: a first buffer including a first driving element configured to provide a first current into a first output node based on the output voltage and first bias circuitry configured to bias the first current; a second buffer including a second driving element configured to provide a second current into a second output node based on a voltage at the first output node and second bias circuitry configured to bias the second current, wherein the second output node is configured to be electrically coupled to a control node of a pass device and wherein the pass device further comprises a first node electrically coupled to a supply and a second node configured to generate the output voltage; controller circuitry configured to generate a control signal based on a current at the pass device; and switching circuitry configured to electrically couple the first output node to the control node of the pass device based on the control signal.

Example 2. The apparatus of example 1, wherein, to generate the control signal, the controller circuitry is configured to generate the control signal to drive the switching circuitry to electrically couple the first output node to the control node of the pass device when the current at the pass device is less than a threshold and drive the switching circuitry to refrain from electrically coupling the first output node to the control node of the pass device when the current at the pass device is not less than the threshold.

Example 3. The apparatus of any combination of examples 1-2, wherein the first driving element comprises a p-type metal-oxide-semiconductor (PMOS) transistor or a PNP transistor; and wherein the second driving element comprises a n-type metal-oxide-semiconductor (NMOS) transistor or an NPN transistor.

Example 4. The apparatus of any combination of examples 1-3, wherein the first bias circuitry is configured to electrically couple a first terminal of the supply to a source of the first driving element and wherein a drain of the first driving element is configured to electrically couple to a second terminal of the supply; and wherein the second bias circuitry is configured to electrically couple the second terminal of the supply to a source of the second driving element and wherein a drain of the second driving element is configured to electrically couple to the first terminal of the supply.

Example 5. The apparatus of any combination of examples 1-4, wherein the first bias circuitry comprises a first current source and the second bias circuitry comprises a second current source; or wherein the first bias circuitry comprises a first resistor and the second bias circuitry comprises a second resistor.

Example 6. The apparatus of any combination of examples 1-5, wherein the controller circuitry is further configured to set the second bias circuitry to bias the second current flow to be less than a current threshold based on the current at the pass device.

Example 7. The apparatus of any combination of examples 1-6, wherein the controller circuitry comprises: a sensing element configured to generate a sense current proportional to the current at the pass device; and third bias circuitry configured to bias the sense current to generate the control signal.

Example 8. The apparatus of any combination of examples 1-7, wherein the controller circuitry comprises a shunt resistor coupled in series with the pass device, wherein, to generate the control signal, the controller circuitry is configured to generate the control signal based on a voltage at the shunt resistor.

Example 9. The apparatus of any combination of examples 1-8, further comprising an error amplifier configured to provide a third current into an input node of the first driving element when an indication of the output voltage is less than a reference voltage.

Example 10. The apparatus of any combination of examples 1-9, wherein the pass device comprises a p-type metal-oxide-semiconductor (PMOS) transistor.

Example 11. A method for low-dropout regulation of an output voltage, the method comprising: providing, based on the output voltage, a first current into a first output node of a first driving element of a first buffer; biasing, by first bias circuitry, the first current; providing, based on a voltage at the first output node, a second current into a second output node of a second driving element of a second buffer; biasing, by second bias circuitry, the second current, wherein the second output node is configured to be electrically coupled to a control node of a pass device and wherein the pass device further comprises a first node electrically coupled to a supply and a second node configured to generate the output voltage; generating a control signal based on a current at the pass device; and electrically coupling the first output node of the first driving element to the control node of the pass device based on the control signal.

Example 12. The method of example 11, wherein generating the control signal comprises generating the control signal to electrically couple the first output node to the control node of the pass device when the current at the pass device is less than a threshold and refraining from electrically coupling the first output node to the control node of the pass device when the current at the pass device is not less than the threshold.

Example 13. The method of any combination of examples 11-12, wherein the first driving element comprises a p-type metal-oxide-semiconductor (PMOS) transistor or a PNP transistor; and wherein the second driving element comprises a n-type metal-oxide-semiconductor (NMOS) transistor or an NPN transistor.

Example 14. The method of any combination of examples 11-13, wherein the first bias circuitry is configured to electrically couple a first terminal of the supply to a source of the first driving element and wherein a drain of the first driving element is configured to electrically couple to a second terminal of the supply; and wherein the second bias circuitry is configured to electrically couple the second terminal of the supply to a source of the second driving element and wherein a drain of the second driving element is configured to electrically couple to the first terminal of the supply.

Example 15. The method of any combination of examples 11-14, wherein the first bias circuitry comprises a first current source and the second bias circuitry comprises a second current source; or wherein the first bias circuitry comprises a first resistor and the second bias circuitry comprises a second resistor.

Example 16. The method of any combination of examples 11-15, further comprising setting the second bias circuitry to bias the second current to be less than a current threshold based on the current at the pass device.

Example 17. The method of any combination of examples 11-16, wherein generating the control signal comprises: generating a sense current proportional to the current at the pass device; and biasing the sense current to generate the control signal.

Example 18. The method of any combination of examples 11-17, wherein generating the control signal comprises generating the control signal based on a voltage at a shunt resistor coupled in series with the pass device.

Example 19. The method of any combination of examples 11-18, wherein the pass device comprises a p-type metal-oxide-semiconductor (PMOS) transistor.

Example 20. A system comprising: a pass device comprising a control node, a first node electrically coupled to a supply, and a second node configured to generate an output voltage; and a circuit configured to perform low-dropout regulation of the output voltage of the pass device, the circuit comprising: a first buffer including a first driving element configured to provide a first current into a first output node based on the output voltage and first bias circuitry configured to bias the first current; a second buffer comprising a second driving element configured to provide a second current into a second output node based on a voltage at the first output node and second bias circuitry configured to bias the second current flow, wherein the second output node is configured to be electrically coupled to the control node of the pass device; controller circuitry configured to generate a control signal based on a current at the pass device; and switching circuitry configured to electrically couple the first output node to the control node of the pass device based on the control signal.

Various aspects have been described in this disclosure. These and other aspects are within the scope of the following claims.

The invention claimed is:

1. A circuit configured to perform low-dropout regulation of an output voltage, the circuit comprising:

a first buffer including a first driving element configured to provide a first current into a first output node based on the output voltage and first bias circuitry configured to bias the first current;

a second buffer including a second driving element configured to provide a second current into a second output node based on a voltage at the first output node and second bias circuitry configured to bias the second current, wherein the second output node is configured to be electrically coupled to a control node of a pass device and wherein the pass device further comprises a first node electrically coupled to a supply and a second node configured to generate the output voltage;

controller circuitry configured to generate a control signal based on a current at the pass device; and switching circuitry configured to electrically couple the first output node to the control node of the pass device based on the control signal.

2. The circuit of claim 1, wherein, to generate the control signal, the controller circuitry is configured to generate the control signal to drive the switching circuitry to electrically couple the first output node to the control node of the pass device when the current at the pass device is less than a threshold and drive the switching circuitry to refrain from electrically coupling the first output node to the control node of the pass device when the current at the pass device is not less than the threshold.

3. The circuit of claim 1, wherein the first driving element comprises a p-type metal-oxide-semiconductor (PMOS) transistor or a PNP transistor; and wherein the second driving element comprises a n-type metal-oxide-semiconductor (NMOS) transistor or an NPN transistor.

4. The circuit of claim 1, wherein the first bias circuitry is configured to electrically couple a first terminal of the supply to a source of the first driving element and wherein a drain of the first driving element is configured to electrically couple to a second terminal of the supply; and wherein the second bias circuitry is configured to electrically couple the second terminal of the supply to a source of the second driving element and wherein a drain of the second driving element is configured to electrically couple to the first terminal of the supply.

5. The circuit of claim 1, wherein the first bias circuitry comprises a first current source and the second bias circuitry comprises a second current source; or wherein the first bias circuitry comprises a first resistor and the second bias circuitry comprises a second resistor.

6. The circuit of claim 1, wherein the controller circuitry is further configured to set the second bias circuitry to bias the second current flow to be less than a current threshold based on the current at the pass device.

7. The circuit of claim 1, wherein the controller circuitry comprises:

a sensing element configured to generate a sense current proportional to the current at the pass device; and third bias circuitry configured to bias the sense current to generate the control signal.

8. The circuit of claim 1, wherein the controller circuitry comprises a shunt resistor coupled in series with the pass device, wherein, to generate the control signal, the controller circuitry is configured to generate the control signal based on a voltage at the shunt resistor.

9. The circuit of claim 1, further comprising an error amplifier configured to provide a third current into an input node of the first driving element when an indication of the output voltage is less than a reference voltage.

10. The circuit of claim 1, wherein the pass device comprises a p-type metal-oxide-semiconductor (PMOS) transistor.

11. A method for low-dropout regulation of an output voltage, the method comprising:

providing, based on the output voltage, a first current into a first output node of a first driving element of a first buffer;

biasing, by first bias circuitry, the first current;

providing, based on a voltage at the first output node, a second current into a second output node of a second driving element of a second buffer;

biasing, by second bias circuitry, the second current, wherein the second output node is configured to be electrically coupled to a control node of a pass device and wherein the pass device further comprises a first node electrically coupled to a supply and a second node configured to generate the output voltage;

generating a control signal based on a current at the pass device; and electrically coupling the first output node of the first driving element to the control node of the pass device based on the control signal.

12. The method of claim 11, wherein generating the control signal comprises generating the control signal to electrically couple the first output node to the control node of the pass device when the current at the pass device is less than a threshold and refraining from electrically coupling the first output node to the control node of the pass device when the current at the pass device is not less than the threshold.

13. The method of claim 11, wherein the first driving element comprises a p-type metal-oxide-semiconductor (PMOS) transistor or a PNP transistor; and wherein the second driving element comprises a n-type metal-oxide-semiconductor (NMOS) transistor or an NPN transistor.

14. The method of claim 11, wherein the first bias circuitry is configured to electrically couple a first terminal of the supply to a source of the first driving element and wherein a drain of the first driving element is configured to electrically couple to a second terminal of the supply; and wherein the second bias circuitry is configured to electrically couple the second terminal of the supply to a source of the second driving element and wherein a drain of the second driving element is configured to electrically couple to the first terminal of the supply.

15. The method of claim 11, wherein the first bias circuitry comprises a first current source and the second bias circuitry comprises a second current source; or wherein the first bias circuitry comprises a first resistor and the second bias circuitry comprises a second resistor.

16. The method of claim 11, further comprising setting the second bias circuitry to bias the second current to be less than a current threshold based on the current at the pass device.

17. The method of claim 11, wherein generating the control signal comprises:

generating a sense current proportional to the current at the pass device; and biasing the sense current to generate the control signal.

18. The method of claim 11, wherein generating the control signal comprises generating the control signal based on a voltage at a shunt resistor coupled in series with the pass device.

19. The method of claim 11, wherein the pass device comprises a p-type metal-oxide-semiconductor (PMOS) transistor.

20. A system comprising:

a pass device comprising a control node, a first node electrically coupled to a supply, and a second node configured to generate an output voltage; and a circuit configured to perform low-dropout regulation of the output voltage of the pass device, the circuit comprising:

a first buffer including a first driving element configured to provide a first current into a first output node based on the output voltage and first bias circuitry configured to bias the first current;

a second buffer comprising a second driving element configured to provide a second current into a second output node based on a voltage at the first output node and second bias circuitry configured to bias the second current flow, wherein the second output node is configured to be electrically coupled to the control node of the pass device;

controller circuitry configured to generate a control signal based on a current at the pass device; and switching circuitry configured to electrically couple the first output node to the control node of the pass device based on the control signal.

* * * * *